US005390489A

United States Patent [19]

Kawai et al.

[11] Patent Number: 5,390,489

[45] Date of Patent: Feb. 21, 1995

[54] AIR-FUEL RATIO CONTROL SYSTEM FOR INTERNAL COMBUSTION ENGINE

[75] Inventors: Katsuhiko Kawai; Hisayo Douta, both of Kariya, Japan

[73] Assignee: Niopondenso Co., Ltd., Kariya, Japan

[21] Appl. No.: 134,814

[22] Filed: Oct. 12, 1993

[30] Foreign Application Priority Data

Oct. 13, 1992 [JP] Japan ..... 4-274600

[51] Int. Cl.[6] ..... F01N 3/20

[52] U.S. Cl. ..... 60/276; 60/285

[58] Field of Search ..... 60/274, 276, 277, 285

[56] References Cited

U.S. PATENT DOCUMENTS 4,027,477 6/1977 Storey ..... 60/276
4,625,697 12/1986 Hosaka ..... 123/478
5,090,199 2/1992 Ikuta et al. .

FOREIGN PATENT DOCUMENTS 0312835 4/1989 European Pat. Off. .
2238147 9/1990 Japan .
3217633 9/1991 Japan .
2242544 10/1991 United Kingdom .

*Primary Examiner*—Ira S. Lazarus
*Assistant Examiner*—Daniel J. O'Connor
*Attorney, Agent, or Firm*—Cushman, Darby & Cushman

[57] ABSTRACT

An air-fuel ratio control system for an internal combustion engine uses a dynamic model which is set as an approximation to a controlled object. The controlled object covers an operation sequence from a fuel injection valve to an air-fuel ratio sensor which is provided downstream of a catalytic converter for detecting an actual air-fuel ratio based on the exhaust gas downstream of the catalytic converter. The system derives a fuel injection amount to be fed to the engine by performing a state-feedback control in such a manner as to control the actual air-fuel ratio to a target air-fuel ratio. The system performs the state-feedback control using, as state variables, current and past input and output data relative to the dynamic model. Accordingly, the actual air-fuel ratio monitored on the downstream-side of the catalytic converter is controlled to the target air-fuel ratio without delay by directly deriving the fuel injection amount using the state-feedback control.

8 Claims, 6 Drawing Sheets

AIR-FUEL RATIO CONTROL SYSTEM FOR INTERNAL COMBUSTION ENGINE

BACKGROUND OF THE INVENTION

1. Field of the Invention

The present invention relates generally to an air-fuel ratio control system for an internal combustion engine, and more specifically, to the air-fuel ratio control system which feedback controls a fuel injection amount so as to control an air-fuel ratio monitored based on the exhaust gas downstream of a catalytic converter to a target air-fuel ratio.

2. Description of the Prior Art

As is known, a fuel injection amount for an internal combustion engine is feedback controlled so as to converge an actual air-fuel ratio monitored based on the exhaust gas to a stoichiometric air-fuel ratio in an effort to ensure the maximum purification efficiency of a catalytic converter. Further, it has been considered desirable to execute such a feedback control based on an air-fuel ratio monitored on the downstream side of the catalytic converter (hereinafter referred to as "downstream-side air-fuel ratio") since the downstream-side air-fuel ratio highly reflects a storage condition or an adsorption condition of the catalytic converter.

This type of an air-fuel ratio control system for an internal combustion engine is disclosed, such as, in Japanese First (unexamined) Patent Publication (Kokai) No. 3-185244 which corresponds to U.S. Pat. No. 5,090,199.

In the disclosed system, an air-fuel ratio sensor (hereinafter referred to as "A/F sensor") monitors an air-fuel ratio based on the exhaust gas upstream of the catalytic converter (hereinafter referred to as "upstream-side air-fuel ratio"), while an $O_2$ sensor detects whether a downstream-side air-fuel ratio is rich or lean relative to the stoichiometric air-fuel ratio. The system performs a so-called modern control, wherein a dynamic model which is an approximation to a controlled object representing an operation series or sequence from a fuel injection valve to the A/F sensor is used to perform a state-feedback control of the fuel injection amount. Specifically, the system uses a detection value of the A/F sensor in the modern control to derive the fuel injection amount by performing the state-feedback control In such a manner as to control the upstream-side air-fuel ratio to the target air-fuel ratio. On the other hand, a detection value of the 02 sensor is used to feedback control the target air-fuel ratio used in the modern control so as to correct the target air-fuel ratio in a direction opposite to a direction of deviation of the downstream-side air-fuel ratio with respect to the stoichiometric air-fuel ratio. Accordingly, the monitored downstream-side air-fuel ratio is reflected on the state-feedback control in the form of correcting the target air-fuel ratio, and thus the control as a whole is executed to control the downstream-side air-fuel ratio to the stoichiometric air-fuel ratio.

As described above, in the conventional air-fuel ratio control system for the internal combustion engine, the downstream-side air-fuel ratio is controlled to be converged to the stoichiometric air-fuel ratio as a result of correcting the target air-fuel ratio used in the state-feedback control depending on a magnitude of the downstream-side air-fuel ratio. Accordingly, when the downstream-side air-fuel ratio is disturbed, the correction of the fuel injection mount based on the sate-feedback control in the modem control is performed only after the correction of the target air-fuel ratio based on the known normal feedback control using the detection value of the $O_2$ sensor, i.e. the downstream-side air-fuel ratio. As a result, a time period required for converging the disturbed downstream-side air-fuel ratio to the stoichiometric air-fuel ratio is prolonged so that an improvement is necessary in view of a response characteristic of the air-fuel ratio control.

SUMMARY OF THE INVENTION

Therefore, It is an object of the present invention to provide an improved air-fuel ratio control system for an internal combustion engine.

According to one aspect of the present invention, an air-fuel ratio control system for an internal combustion engine comprises fuel injection means, provided in an intake passage of the engine, for injecting an mount of fuel to be supplied to the engine; a catalytic converter, provided in an exhaust passage of the engine, for purifying exhaust gas discharged from the engine; air-fuel ratio detecting means, provided in the exhaust passage downstream of the catalytic converter, for detecting an air-fuel ratio of an air-fuel mixture supplied to the engine based on the exhaust gas downstream of the catalytic converter; and fuel injection amount calculating means for calculating the fuel rejection mount of the fuel injection means by performing a state-feedback control in such a manner as to control the air-fuel ratio to a target air-fuel ratio, the fuel injection amount calculating means performing the state-feedback control using, as state variables, current and past input and output data relative to a dynamic model which is set as an approximation to a controlled object, the controlled object representing an operation sequence from the fuel injection means to the air-fuel ratio detecting means.

According to another aspect of the present invention, an air-fuel ratio control system for an internal combustion engine comprises fuel injection means, provided In an intake passage of the engine, for injecting an mount of fuel to be supplied to the engine; a catalytic converter, provided in an exhaust passage of the engine, for purifying exhaust gas discharged from the engine; upstream-side air-fuel ratio detecting means, provided in the exhaust passage upstream of the catalytic converter, for detecting a first air-fuel ratio of an air-fuel mixture supplied to the engine based on the exhaust gas upstream of the catalytic converter; downstream-side air-fuel ratio detecting means, provided in the exhaust passage downstream of the catalytic converter, for detecting a second air-fuel ratio of the air-fuel mixture based on the exhaust gas downstream of the catalytic converter; and fuel injection amount calculating means for calculating the fuel injection amount of the fuel injection means by performing a state-feedback control in such a manner as to control the second air-fuel ratio to a target air-fuel ratio, the fuel injection mount calculating means performing the state-feedback control using, as state variables, current and past input and output data including the first air-fuel ratio, relative to a dynamic model which is set as an approximation to a controlled object, the controlled object representing an operation sequence from the fuel injection means to the downstream-side air-fuel ratio detecting means.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings.

DESCRIPTION OF THE PREFERRED EMBODIMENT

Now, a preferred embodiment of the present invention will be described hereinbelow with reference to the accompanying drawings.

Figure 1:
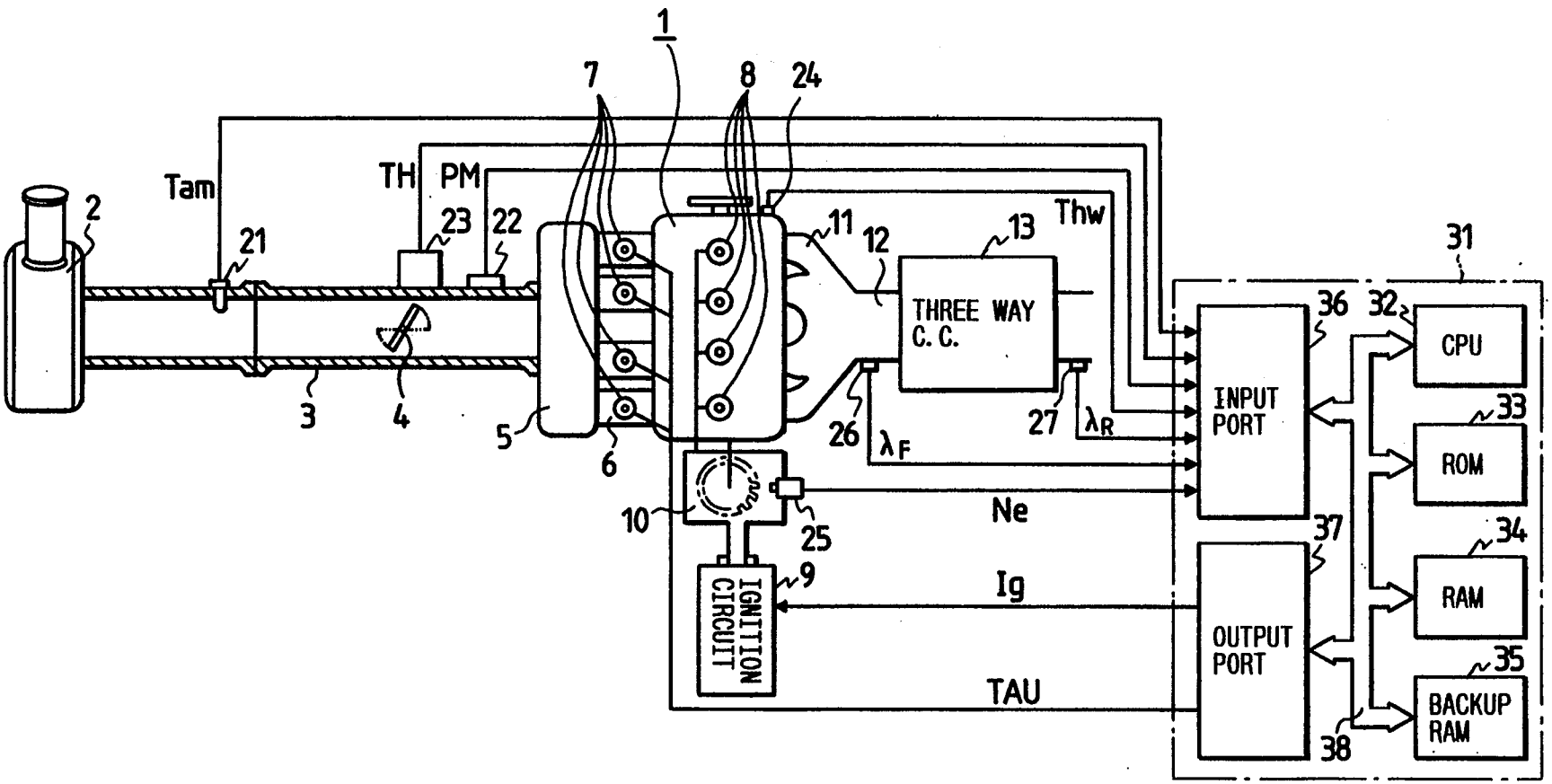
FIG. 1 is a schematic structural diagram of an internal combustion engine and its peripheral devices, incorporating an air-fuel ratio control system according to a preferred embodiment of the present invention.

FIG. 1 is a schematic structural diagram of an internal combustion engine and its peripheral devices, incorporating an air-fuel ratio control system according to the preferred embodiment of the present invention.

In FIG. 1, the engine i is of a spark ignition type of four cylinders and four cycles. Intake air is introduced from the upstream via an air cleaner 2, an intake pipe 3, a throttle valve 4, a surge tank 5 and an intake manifold 6. In the intake manifold 6, the intake air is mixed with fuel injected from a fuel injection valve 7 provided for each engine cylinder so as to form an air-fuel mixture of a given air-fuel ratio, which is then led to the corresponding engine cylinder. To a spark plug 8 for each engine cylinder, a high voltage supplied from an ignition circuit 9 is distributed by a distributor 10 for igniting the mixture gas in each engine cylinder at a given timing. Exhaust gas after combustion is discharged from the engine cylinders and passes through an exhaust manifold 11 and then an exhaust pipe 12. A three way catalytic converter 13 is provided in the exhaust pipe 12 for purifying harmful components such as CO, HC and NOx contained in the exhaust gas. The purified exhaust gas is then discharged to the atmosphere.

An intake air temperature sensor 21 and an intake air pressure sensor 22 are respectively provided in the intake pipe 3. The intake air temperature sensor 21 monitors an intake air temperature Tam upstream of the throttle valve 4, and the intake air pressure sensor 22 monitors an intake air pressure PM downstream of the throttle valve 4. A throttle sensor 23 is further provided for outputting an analog signal indicative of an opening degree TH of the throttle valve 4. The throttle sensor 23 also outputs an on/off signal from an idle switch (not shown), which is indicative of whether the throttle valve 4 is almost fully closed or not. A coolant temperature sensor 24 is mounted to an engine cylinder block for monitoring a temperature Thw of an engine cooling water. A speed sensor 25 is further provided in the distributor 10 for monitoring an engine speed Ne. The speed sensor 25 produces 24 pulses per 720° CA (crank angle), i.e. per two rotations of an engine crankshaft. Further, an upstream-side air-fuel ratio sensor (hereinafter referred to as "upstream-side A/F sensor") 26 is arranged in the exhaust pipe 12 upstream of the three way catalytic converter 13. The upstream-side A/F sensor 26 monitors an air-fuel ratio (excess air ratio) of the air-fuel mixture supplied to the engine based on the exhaust gas on the upstream-side of the three way catalytic converter 13 and produces a linear signal corresponding to the monitored air-fuel ratio (hereinafter referred to as "upstream-side air-fuel ratio λF"). Similarly, a downstream-side air-fuel ratio sensor (hereinafter referred to as "downstream-side A/F sensor") 27 is arranged in the exhaust pipe 12 downstream of the three way catalytic converter 13. The downstream-side A/F sensor 27 monitors an air-fuel ratio (excess air ratio) of the air-fuel mixture supplied to the engine based on the exhaust gas on the downstream-side of the three way catalytic converter 13 and produces a linear signal corresponding to the monitored air-fuel ratio (hereinafter referred to as "downstream-side air-fuel ratio λR").

An electronic control unit (hereinafter referred to as "ECU") 31 for controlling operating conditions of the engine 1 is formed as an arithmetic logic operation circuit mainly comprising a CPU 32, a ROM 33, a RAM 34, a backup RAM 35 and the like which are connected to an input port 36, an output port 37 and the like via a bus 38. The input port 36 is for inputting detection signals from the foregoing sensors, and the output port 37 is for outputting control signals to actuators for controlling operations thereof. Specifically, the ECU 31 receives via the input port 36 the detection signals representative of the intake air temperature Tam, the intake air pressure PM, the throttle opening degree TH, the cooling water temperature Thw, the engine speed Ne, the upstream-side air-fuel ratio λF, the downstream-side air-fuel ratio λR and the like from the foregoing sensors. The ECU 31 calculates a fuel injection amount TAU and an ignition timing Ig based on these input signals and outputs the respective control signals to the fuel injection valves 7 and the ignition circuit 9 via the output port 37 for controlling the operations thereof.

Among these controls, the air-fuel ratio control for deriving the fuel injection amount TAU will be described hereinbelow.

The air-fuel ratio control system in this embodiment uses a so-called modern control theory for performing the air-fuel ratio control. Specifically, a dynamic model which is an approximation to an entire controlled object is preset, and a state-feedback control is performed relative to this preset dynamic model in such a manner as to control the downstream-side air-fuel ratio λR to a stoichiometric air-fuel ratio $\lambda=1$ (target air-fuel ratio $\lambda_{TG}$) so as to derive the fuel injection amount TAU. In the state-feedback control, various state variables which represent an internal state of the dynamic model of the controlled object are used. In this respect, explanation will be first made to a setting procedure of the modern control.

[Setting Procedure of Modem Control]

Figure 2:
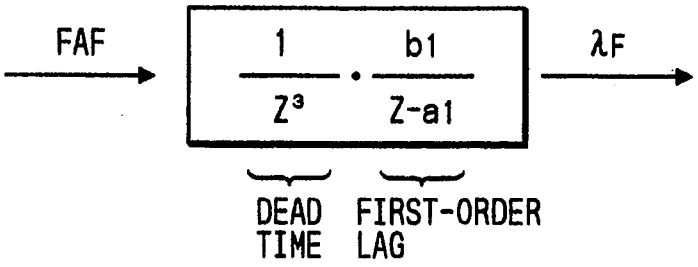
FIG. 2 is an explanatory diagram showing a transfer function to be used when an operation series or sequence from a fuel injection valve to an upstream-side A/F sensor is modeled according to the preferred embodiment of the present invention.
Figure 3:
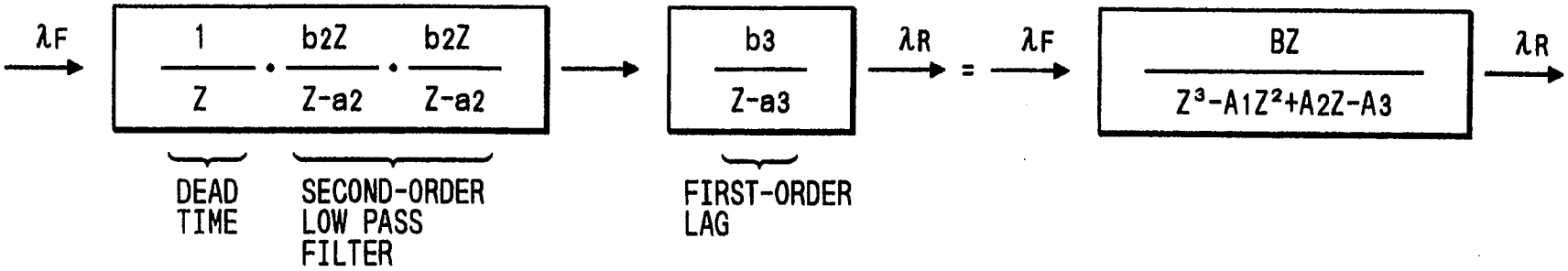
FIG. 3 is an explanatory diagram showing a transfer function to be used when an operation series or sequence from a three way catalytic converter to a downstream-side A/F sensor is modeled according to the preferred embodiment of the present invention.

FIG. 2 is an explanatory diagram showing a transfer function to be used when an operation series or sequence from the fuel injection valve 7 to the upstream-side A/F sensor 26 in the air-fuel ratio control system according to this embodiment is modeled. Similarly, FIG. 3 is an explanatory diagram showing a transfer function to be used when an operation series or sequence from the three way catalytic converter 13 to the downstream-side A/F sensor 27 in the air-fuel ratio control system according to this embodiment is modeled.

[1] Modeling of Object to be controlled

In this embodiment, an entire controlled object covering an operation series or sequence from the fuel injection valve 7 to the downstream-side A/F sensor 27 is approximated to set an entire dynamic model thereof. In practice, however, the entire controlled object is divided into two sections, one covering the operation sequence from the fuel injection valve 7 to the upstream-side A/F sensor 26 and the other covering the operation sequence from the three way catalytic converter 13 to the downstream-side A/F sensor 27, and these two sections are respectively modeled using the intermediate highly reliable sensor information, i.e. the upstream-side air-fuel ratio λF as a combining or associative factor between the two models so as to ensure continuity of the entire dynamic model. This is due to the fact that, when the entire controlled object is modeled as one integral system, the entire system to be modeled becomes so large as to deteriorate the modeling accuracy.

(1) Modeling of Object from Fuel Injection Valve 7 to Upstream-side A/F Sensor 26.

In this embodiment, as a model of the controlled object from the fuel injection valve 7 to the upstream-side A/F sensor 26, an autoregressive moving average model of first order having a dead time P=3 is used, and is further approximated in consideration of a disturbance d. Specifically, a transfer function G from the fuel injection valve 7 to the upstream-side A/F sensor 26 is set as shown in FIG. 2, wherein $a_1$ and $b_1$ represent constants, respectively. It is to be noted that the dead time P of the model may be set to a value other than 3 according to specifications of the engine 1 and its peripheral devices.

Accordingly, the model of the controlled object from the fuel injection valve 7 to the upstream-side A/F sensor 26 using the autoregressive moving average model can be approximated by the following equation (1):

$$\lambda F(i+1)=a_1\cdot\lambda F(i)+b_1\cdot FAF(i-3) \quad (1)$$

wherein λF represents the upstream-side air-fuel ratio, FAF represents an air-fuel ratio correction coefficient for correcting a fuel injection remount of the fuel injection valve 7, and i represents a variable indicative of the number of control times from the start of a first sampling, i.e. the number of sampling times.

Further, when the disturbance d is considered, the model of the controlled object from the fuel injection valve 7 to the upstream-side A/F sensor 26 can be approximated by the following equation (2):

$$\lambda F(i+1)=a_1\cdot\lambda F(i)+b_1\cdot FAF(i-3)+d_1\cdot(i) \quad (2)$$

For the model thus approximated, it is easy to obtain the constants $a_1$ and $b_1$ by discretion based on rotation synchronous (360° CA) samplings using a step response, that is, to obtain the transfer function G of the system from the fuel injection valve 7 to the upstream-side A/F sensor 26.

(2) Modeling of Object from Three Way Catalytic Converter 13 to Downstream-side A/F Sensor 27

In this embodiment, the three way catalytic converter 13 is approximated as a second-order low pass filter having a dead time P'=1, and the downstream-side A/F sensor 27 is approximated as a system having a first-order lag. Specifically, a transfer function G from the three way catalytic converter 13 to the downstream-side A/F sensor 27 is set as shown in FIG. 3, wherein $a_2$, $a_3$, $b_2$, $b_3$, $A_1$, $A_2$, $A_3$ and B represent constants, respectively, and wherein $A_1=2a_2+a_3$, $A_2=a_2^2+2a_2\cdot a_3$, $A_3=a_2^2\cdot a_3$, and $B=b_2^2+b_3$.

Accordingly, a model of the controlled object from the three way catalytic converter 13 to the downstream-side A/F sensor 27 can be approximated by the following equation (3):

$$\lambda R(i+1)=A_1\cdot\lambda R(i)-A_2\cdot\lambda R(i-1)+A_3\cdot\lambda R(i-2)+B\cdot\lambda F(i-1) \quad (3)$$

wherein λR represents the downstream-side air-fuel ratio.

For the model thus approximated, it is easy to obtain the constants $A_1$, $A_2$, $A_3$ and B by discretion based on rotation synchronous (360° CA) saplings using a step response, that is, to obtain the transfer function G of the system from the three way catalytic converter 13 to the downstream-side A/F sensor 27.

[2] Representing Method of State Variables (1) from Fuel Injection Valve 7 to Upstream-side A/F Sensor 26

By rewriting the above equation (2) using state variables $x(i)=[x_1(i), x_2(i), x_3(i), x_4(i)]^T$, the following equations (4) and (5) are obtained:

$$x(i+1)=\begin{bmatrix} a_1 & 0 & 0 & b_1 \\ 0 & 0 & 0 & 0 \\ 0 & 1 & 0 & 0 \\ 0 & 0 & 1 & 0 \end{bmatrix} x(i)+\begin{bmatrix} 0 \\ 1 \\ 0 \\ 0 \end{bmatrix} FAF(i)+\begin{bmatrix} d_1 \\ 1 \\ 0 \\ 0 \end{bmatrix} \quad (4)$$

$$\lambda F(i)=[1\ 0\ 0\ 0]\ x(i) \quad (5)$$

Then, we have $$x_1(i+1)=a_1x_1(i)+b_1x_4(i)+d_1=\lambda F(i+1) \quad (6)$$

$$x_2(i+1)=FAF(i)$$

$$x_3(i+1)=x_2(i)=FAF(i-1)$$

$$x_4(i+1)=x_3(i)=FAF(i-2)$$

The state variables x represent am internal state of the model of the controlled object from the fuel injection valve 7 to the upstream-side A/F sensor 26.

(2) from Three Way Catalytic Converter 13 to Downstream-side A/F Sensor 27

By rewriting the above equation (3) using state variables $z(i)=[z_1(i), z_2(i), z_3(i), z_4(i)]^T$, the following equations (7) and (8) are obtained:

$$z(i+1)=\begin{bmatrix} A_1 & -A_2 & A_3 & B \\ 1 & 0 & 0 & 0 \\ 0 & 1 & 0 & 0 \\ 0 & 0 & 0 & 0 \end{bmatrix} z(i) + \begin{bmatrix} 0 \\ 0 \\ 0 \\ 1 \end{bmatrix} \lambda F(i) \tag{7}$$

$$\lambda R(i) = [1\ 0\ 0\ 0]\ z(i) \tag{8}$$

Then, we have $$\begin{aligned} z_1(i+1) = {} & A_1 z_1(i) - A_2 z_2(i) + A_3 z_3(i) + \\ & B z_4(i) = \lambda R(i+1) \end{aligned} \tag{9}$$

$$z_2(i+1) = z_1(i) = \lambda R(i)$$

$$z_3(i+1) = z_2(i) = \lambda R(i-1)$$

$$z_4(i+1) = \lambda F(i)$$

The state variables z represent an internal state of the model of the controlled object from the three way catalytic converter 13 to the downstream-side A/F sensor 27.

(3) Entire Controlled Object (from Fuel Injection Valve 7 to Downstream-side A/F Sensor 27)

From the above equations (4) and (7), the state variables for the entire controlled object are represented by the following equation (10):

$$\begin{bmatrix} \lambda F(i+1) \\ FAF(i) \\ FAF(i-1) \\ FAF(i-2) \\ \hline \end{bmatrix} = \begin{bmatrix} \lambda R(i+1) \\ \lambda R(i) \\ \lambda R(i-1) \\ \lambda F(i) \end{bmatrix} \tag{10}$$

$$\left[\begin{array}{cccc|cccc} a_1 & 0 & 0 & b_1 & 0 & 0 & 0 & 0 \\ 0 & 0 & 0 & 0 & 0 & 0 & 0 & 0 \\ 0 & 1 & 0 & 0 & 0 & 0 & 0 & 0 \\ 0 & 0 & 1 & 0 & 0 & 0 & 0 & 0 \\ \hline 0 & 0 & 0 & 0 & A_1 & -A_2 & A_3 & B \\ 0 & 0 & 0 & 0 & 1 & 0 & 0 & 0 \\ 0 & 0 & 0 & 0 & 0 & 1 & 0 & 0 \\ 1 & 0 & 0 & 0 & 1 & 0 & 0 & 0 \end{array}\right] \left[\begin{array}{c} \lambda F(i) \\ FAF(i-1) \\ FAF(i-2) \\ FAF(i-3) \\ \hline \lambda R(i) \\ \lambda R(i-1) \\ \lambda R(i-2) \\ \lambda F(i-1) \end{array}\right] + \left[\begin{array}{c} 0 \\ 1 \\ 0 \\ 0 \\ \hline 0 \\ 0 \\ 0 \\ 0 \end{array}\right] FAF(i) + \left[\begin{array}{c} d_1 \\ 0 \\ 0 \\ 0 \\ \hline 0 \\ 0 \\ 0 \\ 0 \end{array}\right]$$

[3] Designing of Regulator

Now, a regulator is designed. When designing the regulator, a deviation e(i) is defined by the following equation (11):

$$e(i)=\lambda_{TG}(=1.0)-\lambda R)i) \tag{11}$$

wherein, $\lambda_{TG}$ represents a target air-fuel ratio of the downstream-side air-fuel ratio λR and is set to the stoichiometric air-fuel ratio λ=1 in this embodiment.

In order to design the state-feedback control which makes zero the deviation e(i), an expanded or augmented system as represented by the following equation (12) is set based on the above equation (10):

$$\begin{bmatrix} (i-q^{-1})\lambda F(i+1) \\ (1-q^{-1})FAF(i) \\ (1-q^{-1})FAF(i-1) \\ (1-q^{-1})FAF(i-2) \\ \hline (1-q^{-1})\lambda R(i+1) \\ (1-q^{-1})\lambda R(i) \\ (1-q^{-1})\lambda R(i-1) \\ (1-q^{-1})\lambda F(i) \\ \hline e(i+1) \end{bmatrix} = \tag{12}$$

$$\left[\begin{array}{cccc|cccc|c} a_1 & 0 & 0 & b_1 & 0 & 0 & 0 & 0 & 0 \\ 0 & 0 & 0 & 0 & 0 & 0 & 0 & 0 & 0 \\ 0 & 1 & 0 & 0 & 0 & 0 & 0 & 0 & 0 \\ 0 & 0 & 1 & 0 & 0 & 0 & 0 & 0 & 0 \\ \hline 0 & 0 & 0 & 0 & A_1 & -A_2 & A_3 & B & 0 \\ 0 & 0 & 0 & 0 & 1 & 0 & 0 & 0 & 0 \\ 0 & 0 & 0 & 0 & 0 & 1 & 0 & 0 & 0 \\ 1 & 0 & 0 & 0 & 0 & 0 & 0 & 0 & 0 \\ \hline 0 & 0 & 0 & 0 & -A_1 & A_2 & -A_3 & -B & 1 \end{array}\right]$$

$$\begin{bmatrix} (i-q^{-1})\lambda F(i) \\ (1-q^{-1})FAF(i-1) \\ (1-q^{-1})FAF(i-2) \\ (1-q^{-1})FAF(i-3) \\ \hline (1-q^{-1})\lambda R(i) \\ (1-q^{-1})\lambda R(i-1) \\ (1-q^{-1})\lambda R(i-2) \\ (1-q^{-1})\lambda F(i-1) \\ \hline e(i) \end{bmatrix} + [0\ 1\ 0\ 0\ \vdots\ 0\ 0\ 0\ 0\ \vdots\ 0]^T (1-q^{-1})FAF(i)$$

wherein, $q^{-1}$ represents a time lag factor.

When the above equation (12) is written as X(i+1)=AX(i)+bU(i), the state-feedback control is represented by the following $$\begin{aligned} FAF(i) = {} & K_1 \cdot \lambda F(i) + K_2 \cdot FAF(i-1) + \\ & K_3 \cdot FAF(i-2) + K_4 \cdot FAF(i-3) + \\ & K_5 \cdot \lambda R(i) + K_6 \cdot \lambda R(i-1) + \\ & K_7 \cdot \lambda R(i-2) + K_8 \cdot \lambda F(i-1) + zI(i) \end{aligned} \tag{13}$$

In the equation (13), an integration term zI(i) is a value determined by the deviation e(i) between the target air-fuel ratio $\lambda_{TG}$ (=1.0) and the actual downstream-side air-fuel ratio λR(i) as defined in the foregoing equation (11) and by an integration constant KI, and is derived by the following equation (14):

$$zI(i)=zI(i-1)+KI\cdot(1.0-\lambda R(i)) \tag{14}$$

Feedback gains $K_1$ to $K_8$ and the integration constant KI can be derived by means of the method of the optimal regulator, which will be described later.

As seen from the equation (13), the state variables are constituted by the state variables x and z and the integration term zI(i) representing an accumulated value of the deviations e between the target air-fuel ratio $\lambda_{TG}$ (=1.0) and the actual downstream-side air-fuel ratios $\lambda R$, and the air-fuel ratio correction coefficient FAF(i) is derived based on those state variables and the feedback gains $K_1$ to $K_8$.

Figure 4:
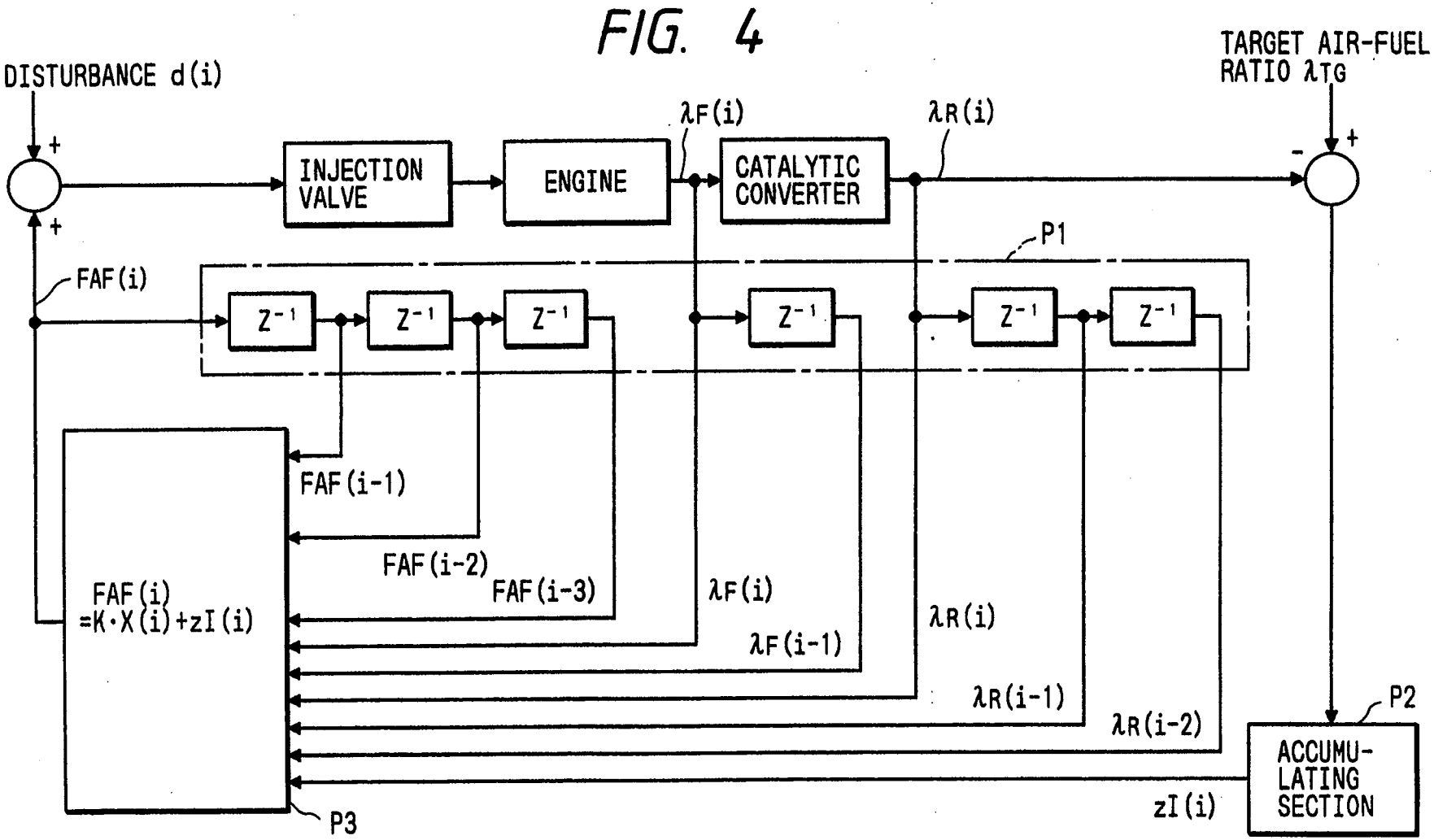
FIG. 4 is a block diagram showing a state-feedback control of a modem control in the air-fuel ratio control system according to the preferred embodiment of the present invention.

FIG. 4 is a block diagram showing the state-feedback control of the modern control in the air-fuel ratio control system according to this embodiment.

In FIG. 4, the $Z^{-1}$ transformation is indicated as deriving the previous or past air-fuel ratio correction coefficient FAF(i−1) from the air-fuel ratio correction coefficient FAF(i). This means that, in practice, the air-fuel ratio correction coefficient FAF(i) is stored in the RAM 34 as a past value and is read out at a next control timing to be used as the air-fuel ratio correction coefficient FAF(i−1).

Further, in FIG. 4, a block P1 surrounded by a one-dot chain line represents a section which determines the state variables x(i) and z(i) in a state where the downstream-side air-fuel ratio $\lambda_{TG}$. A block P2 represents an accumulating section for deriving the integration term zI(i). A block P3 represents a section which calculates a current value of the air-fuel ratio correction coefficient FAF(i) based on the state variables x(i) and z(i) determined at the block P1 and the integration term zI(i) derived at the block P2. In the block P3, although X(1) includes the deviation e(i) in view of the foregoing equation (12) being written as X(i+1)=AX(i)+bU(i), the integration term zI(i) is indicated as being added to K·X(i) for better understanding of the concept of the state-feedback control in this embodiment.

[4] Determination of Optimal Feedback Gains K and Integration Constant KI

The optimal feedback gains $K=[K_1, K_2, K_3, K_4, K_5, K_6, K_7, K_8]$ and the integration constant KI can be set, for example, by minimizing an evaluation function J as represented by the following equation (15):

$$J = \sum_{i=0}^{\infty} \{Q(\lambda R(i) - \lambda_{TG})^2 + R(FAF(i) - FAF(i-1))^2\} \quad (15)$$

The evaluation function J intends to minimize the deviation e(i) between the target air-fuel ratio $\lambda_{TG}$ and the actual downstream-side air-fuel ratio $\lambda R(i)$, while restricting motion of the air-fuel ratio correction coefficient FAF(i). A weighting of the restriction to the air-fuel ratio correction coefficient FAF(i) can be variably set by values of weight parameters Q and R. Accordingly, the optimal feedback gains K and the integration constant KI are determined by changing the values of the weight parameters Q and R to repeat various simulations until the optimal control characteristics are attained.

Further, the optimal feedback gains K and the integration constant KI depend on the model constants $a_1$, $b_1$, $A_1$ to $A_3$ and B. Accordingly, in order to ensure the stability (robust performance) of the system against fluctuation (parameter fluctuation) of the system which controls the actual downstream-side air-fuel ratio $\lambda R$, the optimal feedback gains K and the integration constant KI should be set in consideration of fluctuation amounts of the model constants $a_1$, $b_1$, $A_1$ to $A_3$ and B. For this reason, the simulations are performed taking into account the fluctuation of the model constants $a_1$, $b_1$, $A_1$ to $A_3$ and B which can actually occur, so as to determine the optimal feedback gains K and the integration constant KI which satisfy the stability.

The aforementioned [1] Modeling of Object to be controlled, [2] Representing Method of State Variables, [3] Designing of Regulator and [4] Determination of Optimal Feedback Gains and Integration Constant are determined beforehand. Accordingly, the ECU 31 merely uses their results, that is the foregoing equations (13) and (14) to perform the air-fuel ratio control.

As appreciated from the foregoing description, the air-fuel ratio control system according to this embodiment performs the modern control, wherein the entire controlled object representing the operation sequence from the fuel injection valve 7 to the downstream-side A/F sensor 27 is approximated to set the dynamic model thereof, and the state-feedback control is executed relative to this dynamic model in such a manner as to control the downstream-side air-fuel ratio $\lambda R$ to the stoichiometric air-fuel ratio $\lambda=1$ (target air-fuel ratio $\lambda_{TG}$). Specifically, the air-fuel ratio correction coefficient FAF which can converge the downstream-side air-fuel ratio $\lambda R$ to the target air-fuel ratio $\lambda_{TG}$ is directly calculated based on the foregoing equations (13) and (14). As a result, when the downstream-side air-fuel ratio $\lambda R(i)$ is disturbed, the air-fuel ratio correction coefficient FAF corresponding to that disturbance is immediately calculated so that the downstream-side air-fuel ratio $\lambda R(i)$ is converged to the stoichiometric air-fuel ratio $\lambda=1$ without delay. Accordingly, the response characteristic of the air-fuel ratio control is significantly improved.

Further, as described above, in this embodiment, the controlled object is divided into two sections, one covering the operation sequence from the fuel injection valve 7 to the upstream-side A/F sensor 26 and the other covering the operation sequence from the three way catalytic converter 13 to the downstream-side A/F sensor 27, and these two sections are respectively modeled using the upstream-side air-fuel ratio $\lambda F$ as the combining or associative factor therebetween. Accordingly, the highly reliable dynamic model of the entire controlled object can be easily attained. Further, since the upstream-side air-fuel ratio $\lambda F$, which is highly reliable sensor information, is used as one of the state variables in the modern control, the state-feedback control is realized with high accuracy.

Now, details of the air-fuel ratio control to be executed by the CPU 32 based on the modem control as set in the foregoing manner will be described hereinbelow.

Figure 5:
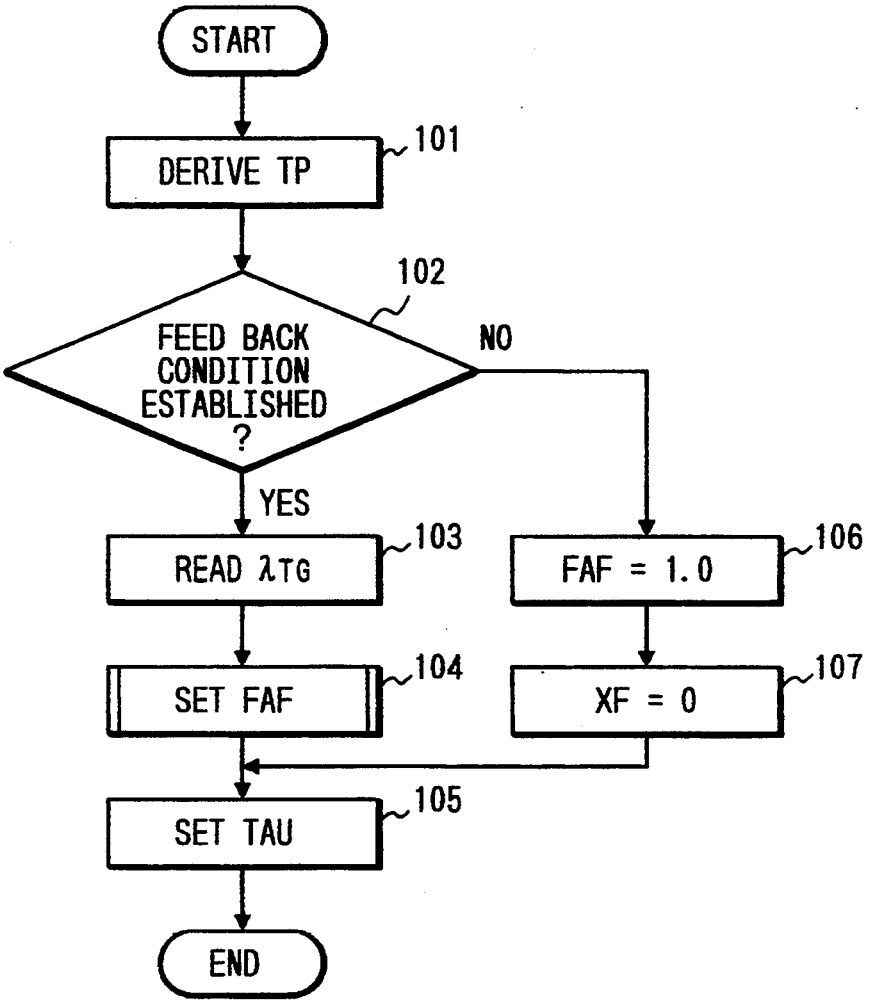
FIG. 5 is a flowchart showing a main routine to be executed by a CPU for deriving a fuel injection amount according to the preferred embodiment of the present invention.

FIG. 5 is a flowchart showing a main routine to be executed by the CPU 32 for deriving the fuel injection amount TAU.

This routine is executed synchronously with engine rotation, i.e. per 360° CA (crank angle). At a first step 101, a basic fuel injection amount Tp is derived based on, such as, the intake air pressure PM and the engine speed Ne. Subsequently, a step 102 determines whether or not an air-fuel ratio feedback control condition is established. As is well known in the art, the feedback control condition is established when tile cooling water temperature Thw is higher than a preset value and when the engine is not at a high speed and not under a high load. If the step 102 determines that the feedback control condition is established, a step 103 reads out the target air-fuel ratio $\lambda_{TG}$ (stoichiometric air-fuel ratio $\lambda=1$ in this embodiment) which is prestored in the ROM 33. Subsequently, at a step 104, the air-fuel ratio correction coefficient FAF for converging the downstream-side air-fuel ratio $\lambda R$ to the target air-fuel ratio $\lambda_{TG}$ (=1.0) is set. Specifically, at the step 104, the air-fuel ratio correction coefficient FAF is calculated based on the target air-fuel ratio $\lambda_{TG}$ and tile downstream-side air-fuel ratio λR detected by the downstream-side A/F sensor 27, using the foregoing equations (13) and (14), which will be described later in detail. Subsequently, the routine proceeds to a step 105. On the other hand, if the step 102 determines that the feedback control condition is not established, the routine proceeds to a step 106 where the air-fuel ratio correction coefficient FAF is set to a value "1.0", and further to a step 107 where a flag XF indicative of the air-fuel ratio feedback control being executed is cleared. Then, the routine proceeds to the step 105.

At the step 105, the fuel injection amount TAU is set based on the basic fuel injection amount Tp, the air-fuel ratio correction coefficient FAF and another known correction coefficient FALL, using the following equation:

$$TAU = Tp \times FAF \times FALL$$

A control signal indicative of the thus set fuel injection amount TAU is supplied to the fuel injection valve 7 for controlling a valve opening time, that is, an actual fuel injection amount to be injected from the fuel injection valve 7. As a result, the actual downstream-side air-fuel ratio λR is converged to the target air-fuel ratio $\lambda_{TG}$ (=1.0).

Figure 6:
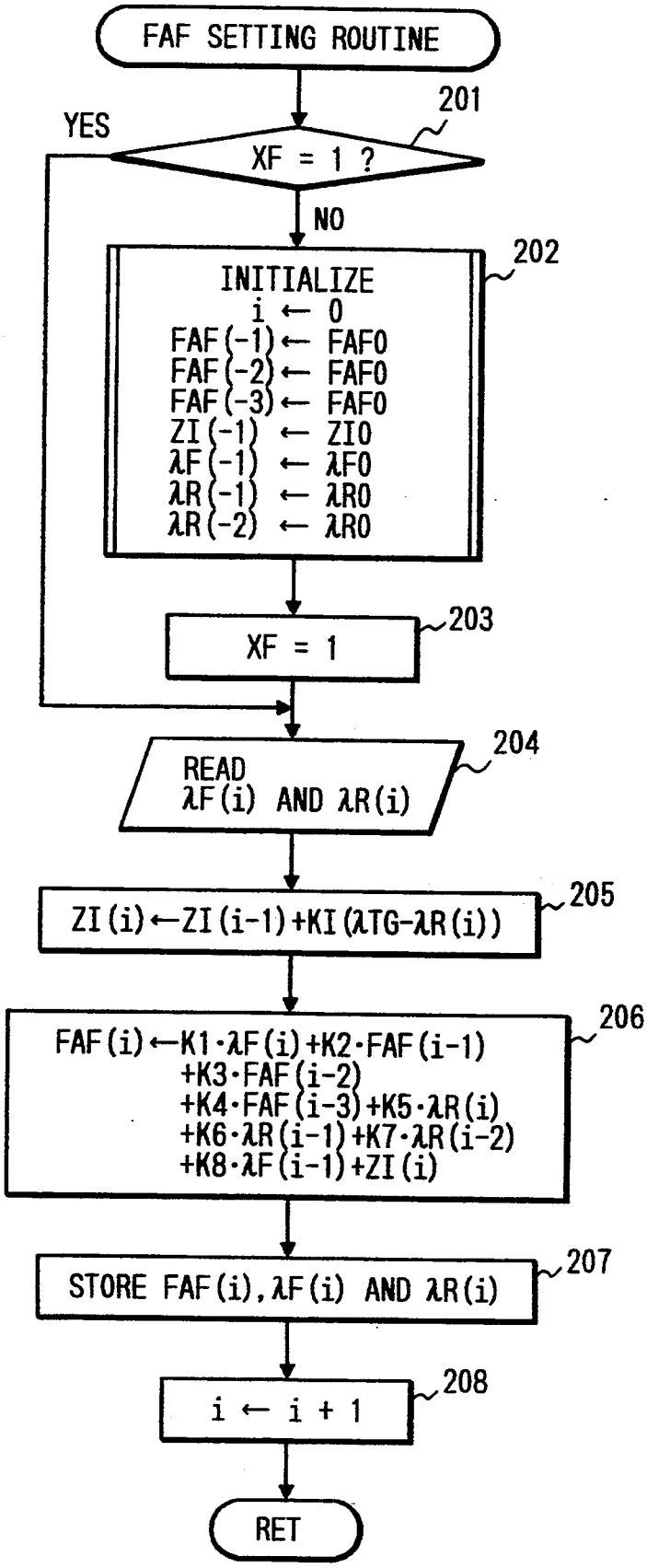
FIG. 6 is a flowchart of a subroutine to be executed by the CPU for deriving an air-fuel ratio correction coefficient according to the preferred embodiment of the present invention.

FIG. 6 is a flowchart of a subroutine corresponding to the step 104 in FIG. 5, to be executed by the CPU 32 for deriving the air-fuel ratio correction coefficient FAF.

At a first step 201, it is determined whether or not the flag XF is set. When the flag XF is not set at the step 201, this means that this subroutine is first executed after establishment of the air-fuel ratio feedback control condition during execution of the step 106. Accordingly, the routine proceeds to a step 202 which executes initialization of associated values. For example, the variable i indicative of the number of sapling times is set to 0 (zero), the initial values FAF(−1), FAF(−2) and FAF(−3) are respectively set to a constant FAF0, the initial value zI(−1) of the accumulated value of deviations between the target air-fuel ratio $\lambda_{TG}$ and the downstream-side air-fuel ratios λR is set to a constant zI0, the initial value λF(−1) is set to a constant λF0, and the initial values λR(−1) and λR(−2) are respectively set to a constant λRO. These initialized values are respectively set in predetermined areas of the RAM 34.

Thereafter, the routine proceeds to a step 203 where the flag XF is set, and then to a step 204. Accordingly, further execution cycles of this subroutine skip the steps 202 and 203 as long as the air-fuel ratio feedback control condition continues to be established at the step 102 in FIG. 5. On the other hand, assuming that the step 102 determines non-establishment of the feedback control condition to allow the step 106 to be executed, and thereafter the feedback control condition is again established at the step 102 to allow the step 104 to be executed, the initialization is again executed at the step 202.

Referring back to the step 204, the upstream-side air-fuel ratio λF(i) and the downstream-side fuel ratio λR(i) are respectively read in via the input port 36 from the upstream-side A/F sensor 26 and the downstream-side A/F sensor 27. Subsequently, a step 205 uses the foregoing equation (14) to derive the deviation e(i) between the target air-fuel ratio $\lambda_{TG}$ (=1.0) and the downstream-side air-fuel ratio λR(i) and to finally derive the integration term zI(i) by accumulating the deviations e. The routine now proceeds to a step 206 where, according to the foregoing equation (13), the air-libel ratio correction coefficient FAF(i) is calculated using the state variables x and z, the optimal feedback gains K and the integration terra zI(i).

Subsequently, at a step 207, the current upstream-side and downstream-side air-fuel ratios λF(i) and λR(i) and air-fuel ratio correction coefficient FAF(i) are stored and updated in predetermined areas of the RAM 34 as tile previous upstream-side and downstream-side air-fuel ratios λF(i−1) and λR(i−1) and air-fuel ratio correction coefficient FAF(i−1) for a subsequent cycle of this subroutine. Thereafter, the routine proceeds to a step 208 where the variable i is incremented by "1", and is terminated.

In the preferred embodiment as described above, the upstream-side air-fuel ratio λF as the state variable and the downstream-side air-fuel ratio λR as the state variable as well as a control amount are respectively detected by the A/F sensors 26 and 27 which both output linear detection signals depending on the monitored air-fuel ratio. However, other sensors may be used instead thereof as long as they can detect the air-fuel ratio based on the exhaust gas upstream and downstream of the three way catalytic converter 13. For example, $O_2$ sensors may be used instead of the A/F sensors 26 and 27 as will be described hereinbelow.

In this modification, the $O_2$ sensor instead of the A/F sensor 26 is provided upstream of the catalytic converter 13 and produces an output voltage VOX1 which represents a sudden change across the stoichiometric air-fuel ratio λ=1. Similarly, the $O_2$ sensor instead of the A/F sensor 27 is provided downstream of the catalytic converter 13 and produces an output voltage VOX2 which also represents a sudden change across the stoichiometric air-fuel ratio λ=1.

Figure 7:
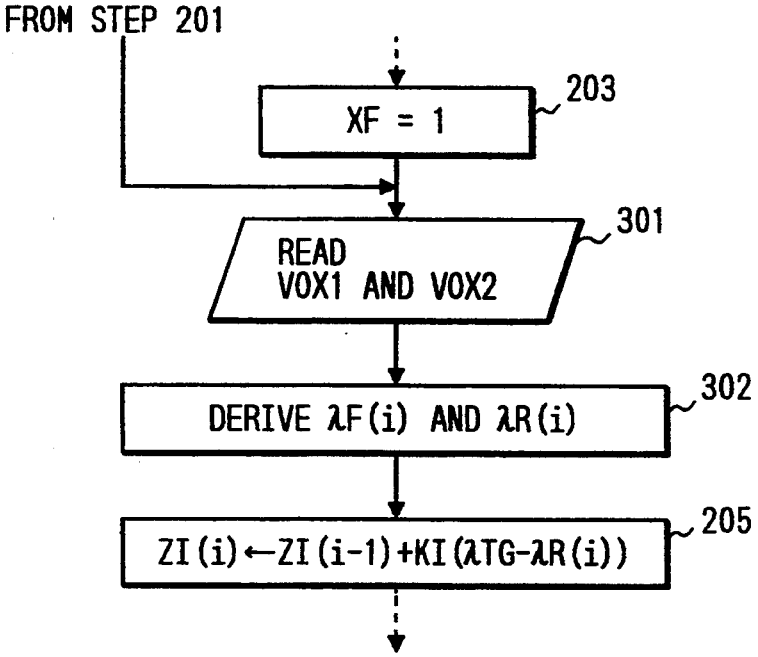
FIG. 7 is a flowchart of a subroutine to be executed by the CPU for deriving an air-fuel ratio correction coefficient according to a modification of FIG. 6.

FIG. 7 is a flowchart of a subroutine corresponding to the step 104 in FIG. 5. The flowchart of FIG. 7 only differs from that of FIG. 6 in that the step 204 of FIG. 6 is replaced by steps 30 1 and 302. Accordingly, the following explanation will be made to only such a difference so as to avoid redundant disclosure.

Figure 8:
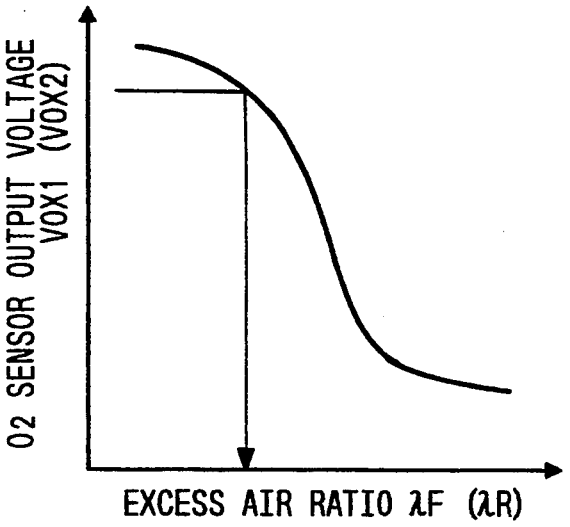
FIG. 8 is a characteristic map for linearizing output voltages of $O_2$ sensors in the modification shown in FIG. 7.

FIG. 8 is a characteristic map for linearizing the output voltages VOX1 and VOX2 so as to derive excess air ratios λF and λR, that is, the upstream-side air-fuel ratio λF and the downstream-side air-fuel ratio λR.

At the step 301, the output voltages VOX1 and VOX2 of the $O_2$ sensors are read out. Subsequently, at the step 302, the excess air ratios λF and λR are respectively derived from the output voltages VOX1 and VOX2 using the characteristic map of FIG. 8. In other words, the excess air ratios λF rand λR are derived using a narrow transitional area across the stoichiometric air-fuel ratio λ=1 where the output voltages VOX1 and VOX2 respectively represent sudden changes. After the step 302, the routine proceeds through the steps 205 to 208 where the same processes are executed as described with reference to FIG. 6.

As appreciated, in the modification as described above, the state-feedback control in the modem control can be performed as in the foregoing preferred embodiment.

In another modification, one of the upstream-side and downstream-side air-fuel ratios λF and λR may be detected by the A/F sensor and the other by the $O_2$ sensor.

It is to be understood that this invention is not to be limited to the preferred embodiment and modification described above, and that various changes and modifications may be made without departing from the spirit and scope of the invention as defined in the appended claims.

What is claimed is:

1. An air-fuel ratio control system for an internal combustion engine, comprising:

fuel injection means, provided in an intake passage of said engine, for injecting an amount of fuel to be supplied to said engine;

a catalytic converter, provided in an exhaust passage of said engine, for purifying exhaust gas discharged from said engine;

downstream-side air-fuel ratio detecting means, provided in said exhaust passage downstream of said catalytic converter, for detecting an air-fuel ratio of an air-fuel mixture supplied to said engine based on said exhaust gas downstream of said catalytic converter;

upstream-side air-fuel ratio detecting means, provided in said exhaust passage upstream of said catalytic converter, for detecting an air-fuel ratio of air-fuel mixture supplied to said engine based on said exhaust gas upstream of said catalytic converter; and fuel injection amount calculating means for calculating said fuel injection amount of said fuel injection means by performing a state-feedback control in such a manner as to control said air-fuel ratio detected by said downstream-side air-fuel ratio detecting means to a target air-fuel ratio, said fuel injection amount calculating means performing said state-feedback control using, as state variables, current and past input and output data relative to a dynamic model which is set as an approximation to a controlled object, said controlled object representing an operation sequence from said fuel injection means to said downstream-side air-fuel ratio detecting means;

wherein said controlled object is divided into first and second sections, said first section covering an operation sequence from said fuel injection means to said upstream-side air-fuel ratio detecting means and said second section covering an operation sequence from said catalytic converter to said downstream-side air-fuel ratio detecting means; and wherein said dynamic model is formed by first and second models, said first model representing an approximation to said first section of said controlled object and said second model representing an approximation to said second section of said controlled object.

2. An air-fuel ratio control system for an internal combustion engine, comprising:

fuel injection means, provided in an intake passage of said engine, for injecting an amount of fuel to be supplied to said engine;

a catalytic converter, provided in an exhaust passage of said engine, for purifying exhaust gas discharged from said engine;

upstream-side air-fuel ratio detecting means, provided in said exhaust passage upstream of said catalytic converter, for detecting a first air-fuel ratio of an air-fuel mixture supplied to said engine based on exhaust gas upstream of said catalytic converter;

downstream-side air-fuel ratio detecting means, provided in said exhaust passage downstream of said catalytic converter, for detecting a second air-fuel ratio of said air-fuel mixture based on said exhaust gas downstream of said catalytic converter; and fuel injection amount calculating means for calculating said fuel injection amount of said fuel injection means by performing a state-feedback control in such a manner as to control said second air-fuel ratio to a target air-fuel ratio, said fuel injection amount calculating means performing said state-feedback control using, as state variables, current and past input and output data including said first air-fuel ratio, relative to a dynamic model which is set as an approximation to a controlled object, said controlled object representing an operation sequence from said fuel injection means to said downstream-side air-fuel ratio detecting means;

wherein said controlled object is divided into first and second sections, said first section covering an operation sequence from said fuel injection means to said upstream-side air-fuel ratio detecting means and said second section covering an operation sequence from said catalytic converter to said downstream-side air-fuel-ratio detecting means; and wherein said dynamic model is formed by first and second models, said first model representing an approximation to said first section of said controlled object and said second model representing an approximation to said second section of said controlled object.

3. The system as set forth in claim 2, wherein said fuel injection amount calculating means performs said state-feedback control using the state variables for said first model and the state variables for said second model.

4. The system as set forth in claim 2, wherein said first air-fuel ratio detected by said upstream-side air-fuel ratio detecting means works as an associative factor between said first and second models so as to ensure continuity of said dynamic model.

5. The system as set forth in claim 2, wherein said state variables include, in addition to said first air-fuel ratio, said second air-fuel ratio, a value indicative of said fuel injection mount and an accumulated value indicative of accumulated difference between said target air-fuel ratio and said second air-fuel ratio.

6. The system as set forth in claim 5, wherein said target air-fuel ratio is a fixed value representing a stoichiometric air-fuel ratio.

7. The system as set forth in claim 5, wherein said fuel injection amount calculating means includes first means for performing said state-feedback control to derive an air-fuel ratio correction coefficient and second means for deriving said fuel injection amount based on said air-fuel ratio correction coefficient, and wherein said value indicative of the fuel injection amount is a past value of said air-fuel ratio correction coefficient.

8. The system as set forth in claim 7, wherein said first means performs the state-feedback control represented by the following equation:

$$\begin{aligned} FAF(i) = \; & K_1 \cdot \lambda F(i) + K_2 \cdot FAF(i-1) + \\ & K_3 \cdot FAF(i-2) + K_4 \cdot FAF(i-3) + \\ & K_5 \cdot \lambda R(i) + K_6 \cdot \lambda R(i-1) + \\ & K_7 \cdot \lambda R(i-2) + K_8 \cdot \lambda F(i-1) + zI(i) \end{aligned}$$

wherein, FAF represents said air-fuel ratio correction coefficient, $\lambda F$ represents said first air-fuel ratio, $\lambda R$ represents said second air-fuel ratio, $K_1$ to $K_8$ respectively represent optimal feedback gains which are preset according to said dynamic model, zI represents said accumulated value, and i represents the number of sampling times.

* * * * *